US008061665B2

(12) United States Patent
Solis et al.

(10) Patent No.: US 8,061,665 B2
(45) Date of Patent: Nov. 22, 2011

(54) FRAMING BRACKET

(75) Inventors: Joe A Solis, Katy, TX (US); Michael W Pechacek, Magnolia, TX (US); Julio C Alquicra, Houston, TX (US)

(73) Assignee: Weyerhaeuser Real Estate Company, Federal Way, WA (US)

( * ) Notice: Subject to any disclaimer, the term of this patent is extended or adjusted under 35 U.S.C. 154(b) by 755 days.

(21) Appl. No.: 12/029,947

(22) Filed: Feb. 12, 2008

(65) Prior Publication Data

US 2009/0200442 A1 Aug. 13, 2009

(51) Int. Cl.
*E04G 3/00* (2006.01)

(52) U.S. Cl. ..... 248/219.1; 248/219.3; 248/201; 182/187

(58) Field of Classification Search ..... 248/220.21, 248/222.51, 220.22, 236, 216.4, 682, 201, 248/218.4, 219.1, 219.3, 229.1, 295.11, 297.21; 182/133–136, 90–92, 187, 188, 221
See application file for complete search history.

(56) References Cited

U.S. PATENT DOCUMENTS

| | | | | | |
|---|---|---|---|---|---|
| 3,460,649 | A | * | 8/1969 | Baker et al. | 182/187 |
| 3,776,498 | A | * | 12/1973 | Peters et al. | 248/219.1 |
| 5,156,236 | A | * | 10/1992 | Gardner | 182/187 |
| 5,771,991 | A | * | 6/1998 | Fresco | 182/82 |
| 5,971,104 | A | * | 10/1999 | Woller | 182/136 |
| D575,411 | S | * | 8/2008 | Woller et al. | D25/62 |
| D596,015 | S | * | 7/2009 | Scarcello | D8/366 |

* cited by examiner

*Primary Examiner* — Terrell McKinnon
*Assistant Examiner* — Steven Marsh
(74) *Attorney, Agent, or Firm* — Christensen O'Connor Johnson Kindness

(57) ABSTRACT

A framing bracket is provided. The framing bracket includes a frame having a leg extending from a support arm. The framing bracket also includes a locking bracket attached to one end of the frame and an anchoring bracket attached to a second end of the frame. The locking bracket is affixed to the frame at a non-normal angle relative to a longitudinal axis extending through the leg such that the locking bracket is locked to a framing member of a building and the anchoring bracket supports the second end of the leg against the framing member when the framing bracket is removably attached to the framing member and the framing bracket is in a locked position.

15 Claims, 4 Drawing Sheets

FRAMING BRACKET

BACKGROUND

Construction of buildings, such as homes, requires the use of scaffolding to provide a safe and stable platform for installation of wall studs. One such scaffold includes a pair of spaced brackets coupled to finger jointed studs by fasteners, such as nails. A walker board is placed on top of the spaced brackets to provide a walking surface for carpenters. Although such scaffolding is effective, it is not without its problems.

As a non-limiting example, because the entire weight of the construction worker(s) is supported by the scaffolding, fasteners alone are often inadequate to provide sufficient anchoring capability. Such fasteners often fail, thereby leading to possible significant workplace injury to not only those supported by the scaffolding, but also to those working near the scaffolding. Thus, existing and available scaffolding require additional support structure. This leads to increased expenses associated with the construction of the additional support structure, both in terms of time and materials. As such, there exists a need for framing bracket that provides necessary support for scaffolding at a construction worksite.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A framing bracket is provided. The framing bracket includes a frame having a leg extending from a support arm. The framing bracket also includes a locking bracket attached to one end of the frame and an anchoring bracket attached to a second end of the frame. The locking bracket is affixed to the frame at a non-normal angle relative to a longitudinal axis extending through the leg such that the locking bracket is locked to a framing member of a building and the anchoring bracket supports the second end of the leg against the framing member when the framing bracket is removably attached to the framing member and the framing bracket is in a locked position.

DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
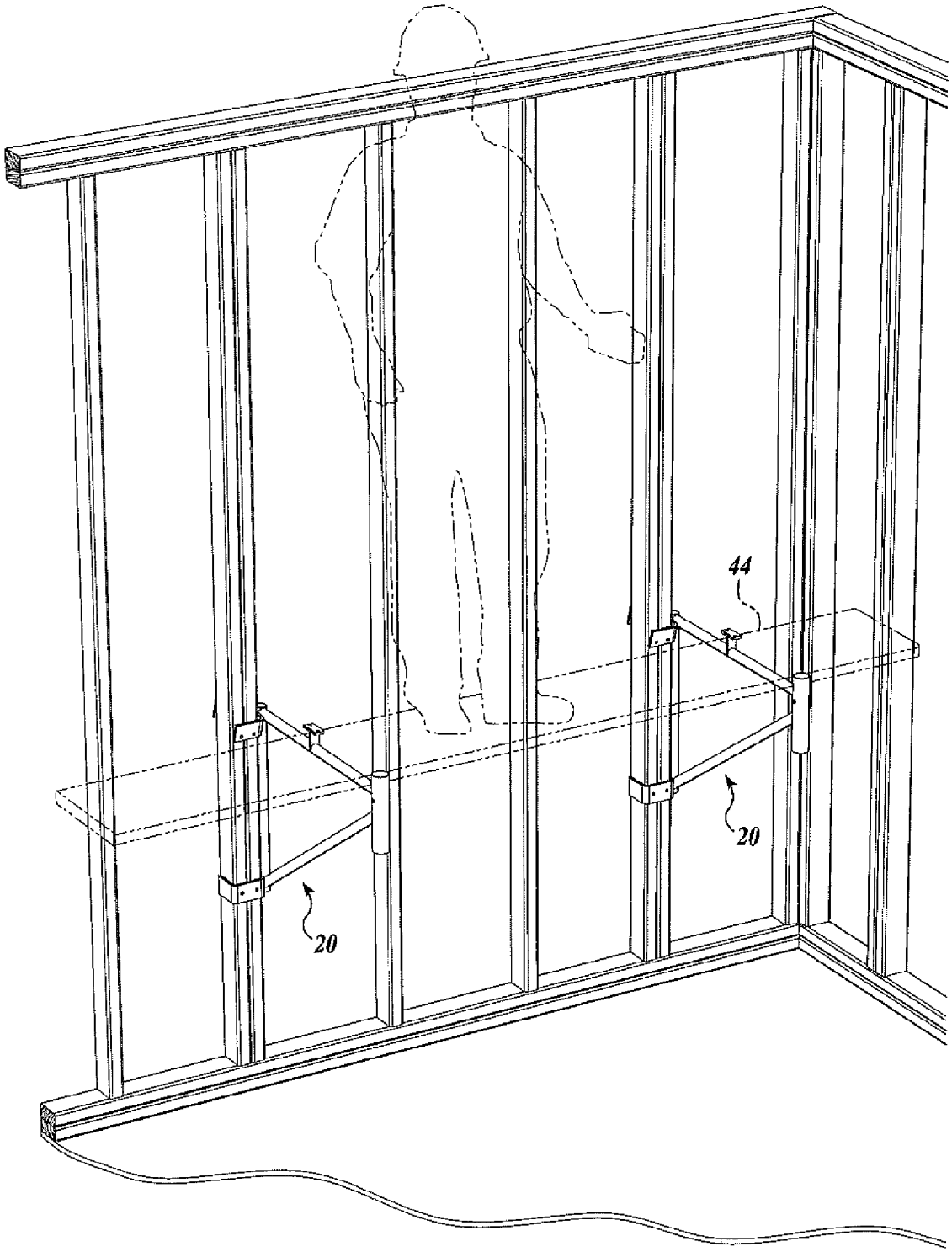
FIG. 1 is an environmental view of a framing bracket constructed in accordance with one embodiment of the present disclosure.
Figure 2:
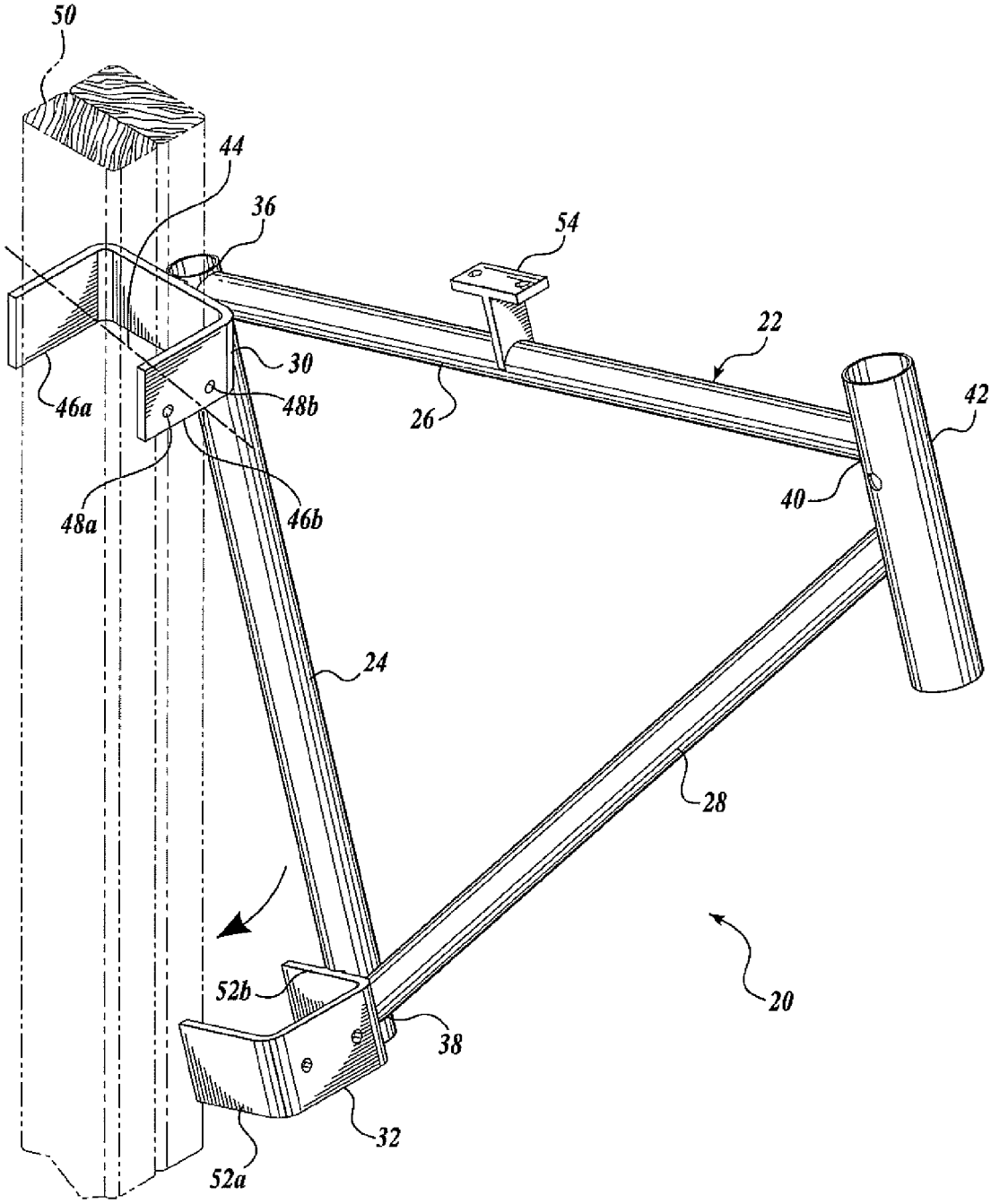
FIG. 2 is an isometric view of the framing bracket of FIG. 1, showing an environmental view of a locking bracket and anchoring bracket.

A framing bracket 20 constructed in accordance with one embodiment of the present disclosure may be best understood by referring to FIGS. 1 and 2. The framing bracket 20 is suitably manufactured from a high strength material, such as steel, and includes a frame 22 having a leg 24, a support arm 26 and a brace 28. The framing bracket 20 also includes a locking bracket 30 and an anchoring bracket 32.

The leg 24 is suitably a tubular member and defines a longitudinal axis 34 extending between first and second ends 36 and 38. The support arm 26 is fastened to the first end 36 of the leg 24 in accordance with any well-known manner, including welding.

The support arm 26 is similarly constructed as the leg 22 and includes a free end 40. The free end 40 may include an optional end cap 42 suitably fastened in a well-known manner, such as welding. The end cap 42 is configured to assist in stabilizing a walk board 44 during use, as described in greater detail below.

The brace 28 is suitably a tubular member and extends between the second end 38 of the leg 24 and either the free end 40 of the support arm 26 or the end cap 42. The brace 28 provides stiffening to the frame 22 for added stability of the framing bracket 20 during use.

As may best seen by referring to FIG. 2, the locking bracket 30 is suitably formed from a high strength material, such as steel, and is C-shaped in configuration. The locking bracket 30 defines a locking bracket axis 44 extending between opposed surfaces 46*a* and 46*b* of the locking bracket 30. The locking bracket 30 is attached to the frame 20 such that the locking bracket axis 44 is at an angle 45 that is non-normal relative to the longitudinal axis 34 extending through the leg 24. As a non-limiting example, the angle 45 is obtuse. Although the angle 45 is illustrated and described as obtuse, it should be apparent that acute angles are also within the scope of the appended claims.

The locking bracket 30 also includes a pair of anchoring bores 48*a* and 48*b* extending through one of the opposed surfaces. The anchoring bores 48*a* and 48*b* are adapted to receive a well-known fastener (not shown), such as a framing nail, to provide supplemental anchoring of the framing bracket 20 during use. The opposed surfaces 46*a* and 46*b* of the locking bracket 30 are spaced to cradle the sides of a framing member 50, such as studs. The framing member 50 has a framing member axis 60 extending through the center of the framing member 50.

The anchoring bracket 32, like the locking bracket 30, is suitably formed from a high strength material and is also C-shaped in configuration. Opposed surfaces 52*a* and 52*b* are sized to cradle the end of the framing member 50 when the framing bracket 20 is removably attached to the framing member 50. As configured, the locking bracket 30 and the anchoring bracket 32 are positioned on the frame 22 such that a first plane extending through the open end and parallel to the closed surface of one the brackets is normal to a second plane extending through the open end and parallel to the closed surface of the other bracket.

The framing bracket 20 may also include a support bracket 54 extending from the support arm 26. The supporting bracket 54 and the end cap 42 work together to provide a more stable working platform for the walk board 44 when the framing bracket 20 is in use.

Figure 3:
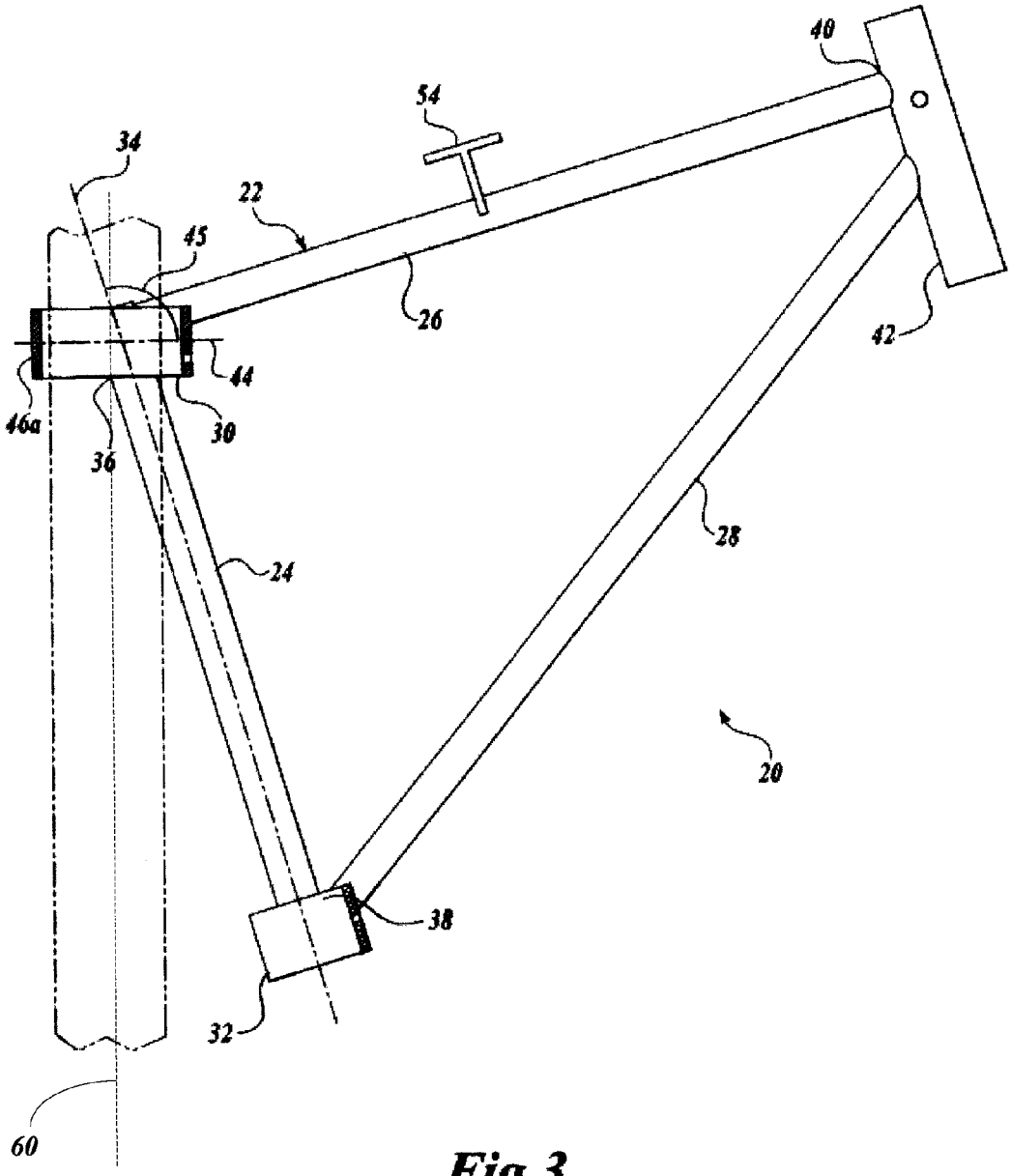
FIG. 3 is a side planar view of the framing bracket of FIG. 1, showing the framing bracket in an unlocked position and the locking bracket and anchoring bracket in cross-section.
Figure 4:
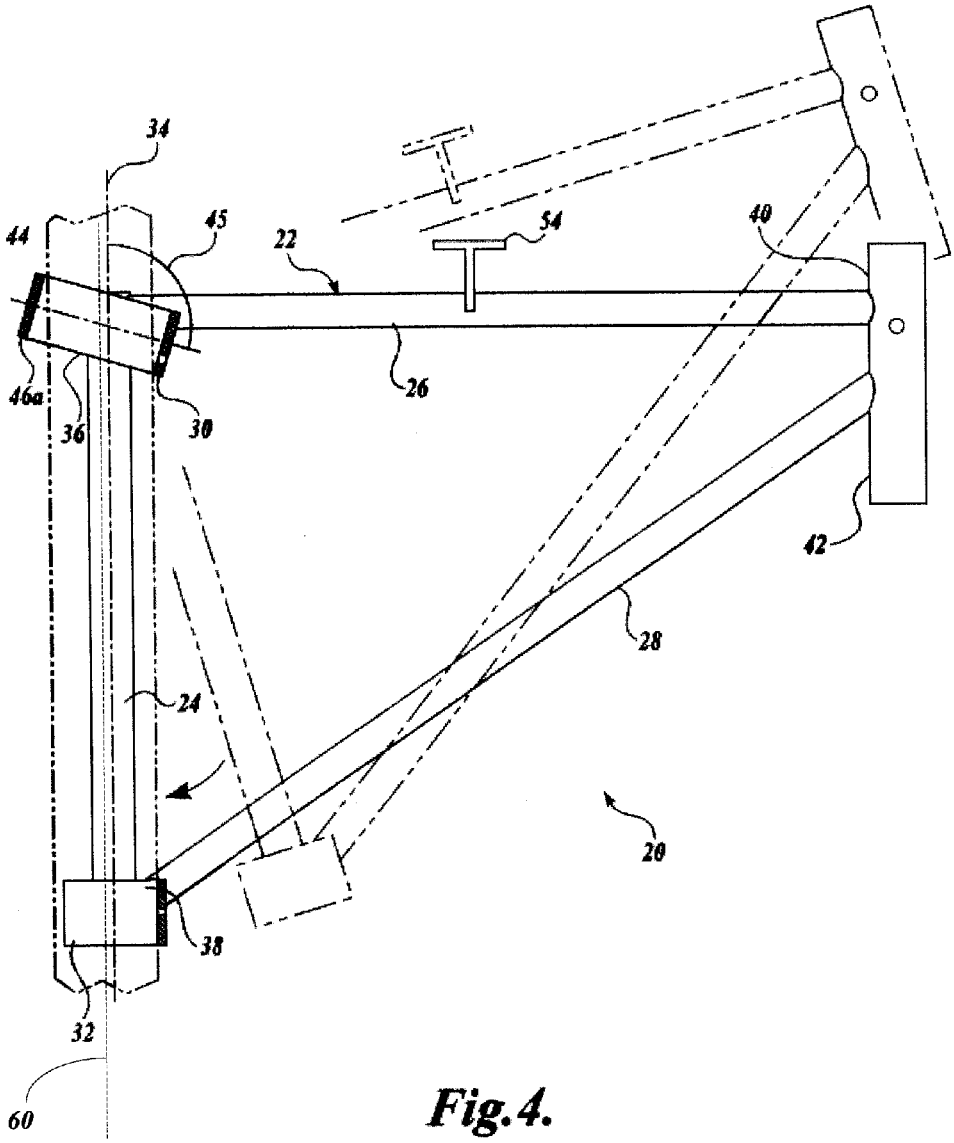
FIG. 4 is a side planar view of the framing bracket of FIG. 3, showing the framing bracket in a locked position.

Operation of the framing bracket 20 may be best understood by referring to FIGS. 3 and 4. In FIG. 3, the framing bracket 20 is illustrated in an unlocked position. In this position, the framing member 50 is cradled between the opposed surfaces 46*a* and 46*b* of the locking bracket 30 and the anchoring bracket 32 is not attached to the framing member 50. The framing bracket 20 is transitioned into a locked position as seen in FIG. 4 by rotating the anchoring bracket 32 into engagement with the framing member 50 such that the framing member 50 is cradled between the opposed surfaces 46*a*, 46*b* and 52*a*, 52*b* of both the locking and anchoring bracket 30 and 32.

As the framing bracket 20 is transitioned into the locked position, the framing member 50 is locked between the opposed surfaces 46*a* and 46*b*. That is, the framing member 50 is wedged between the opposed surfaces 46*a* and 46*b* of the locking bracket 30 to anchor the framing bracket 20 in position. As noted above, to supplement anchoring, fasteners (not shown) may be inserted into the bore 48*a* and 48*b*. As secured to the framing member 50, the anchoring bracket 32 provides support to the scaffolding. To remove the framing bracket 20, the just described steps are reversed.

While illustrative embodiments have been illustrated and described, it will be appreciated that various changes can be made therein without departing from the spirit and scope of the invention.

The embodiments of the invention in which an exclusive property or privilege is claimed are defined as follows:

1. A framing bracket, comprising:

(a) a frame having a leg extending from a support arm;

(b) a locking bracket attached to one end of the frame; and (c) an anchoring bracket attached to a second end of the frame, wherein the locking bracket is affixed to the frame at a non-normal angle relative to a longitudinal axis extending through the leg such that the locking bracket is locked to a framing member of a building and the anchoring bracket supports the second end of the leg against the framing member when the framing bracket is removably attached to the framing member and the framing bracket is in a locked position;

wherein the longitudinal axis is substantially skew with respect to a framing member axis;

wherein the support arm is perpendicular to the framing member axis when the framing bracket is in the locked position, the framing member axis extending through the framing member; and wherein the support arm is not perpendicular to the framing member axis when the framing bracket is in an unlocked position.

2. The framing bracket of claim 1, wherein the non-normal angle is an obtuse angle.

3. The framing bracket of claim 2, wherein the framing member is wedged between a lower surface and an upper surface of opposed arms of the locking bracket when the locking bracket is in the locked position.

4. The framing bracket of claim 3, further comprising a support bracket disposed on the support arm and positioned to support a platform.

5. The framing bracket of claim 3, further comprising an anchoring fastener adapted to be removably coupled to the locking bracket to provide supplement anchoring of the framing bracket to the framing member when the framing bracket is removably attached to the framing member and the framing bracket is in the locked position.

6. The framing bracket of claim 3, wherein the locking bracket and the anchoring bracket are positioned on the frame such that a first plane extending through an open end and parallel to a closed surface of either the locking or the anchoring bracket is normal to a second plane extending through an open end and parallel to a closed surface of the other bracket.

7. A framing bracket, comprising:

(a) a frame having a leg and support arm extending substantially normally from the leg;

(b) a locking bracket attached to one end of the leg, the locking bracket having a locking bracket axis extending through a longitudinal direction of the locking bracket; and (c) an anchoring bracket attached to a second end of the leg, wherein the locking bracket is affixed to the frame such that the locking bracket axis is at a non-normal angle relative to a longitudinal axis extending through the leg to lock opposed surfaces of the locking bracket to a framing member of a building when the framing bracket is removably attached to the framing member and the framing bracket is in a locked position;

wherein the longitudinal axis is substantially skew with respect to a framing member axis;

wherein the support arm is perpendicular to the framing member axis when the framing bracket is in the locked position, the framing member axis extending through the framing member; and wherein the support arm is not perpendicular to the framing member axis when the framing bracket is in an unlocked position.

8. The framing bracket of claim 7, wherein the non-normal angle is an obtuse angle.

9. The framing bracket of claim 7, further comprising a support bracket positioned on the support arm and positioned to provide support to a platform.

10. The framing bracket of claim 7, further comprising a plurality of anchor fasteners extending through the locking bracket and the anchoring bracket when the framing bracket is in the locked position to provide supplemental anchoring for the framing bracket.

11. The framing bracket of claim 7, wherein the locking bracket and the anchoring bracket are positioned on the frame such that a first plane extending through an open end and parallel to a closed surface of one either the locking or the anchoring bracket is normal to a second plane extending through an open end and parallel to a closed surface of the other bracket.

12. A framing bracket, comprising:

(a) a frame having:

a leg having a longitudinal axis extending between first and second ends;

(ii) a support arm extending substantially normally from the first end of the leg; and (iii) a brace extending from the second end of the leg to a free end of the support arm;

(b) a locking bracket attached to one end of the leg, the locking bracket having a locking bracket axis extending through a longitudinal direction of the locking bracket; and (c) an anchoring bracket attached to a second end of the leg, wherein the locking bracket and positioned on the frame at a non-normal angle relative to the longitudinal axis of the leg such that opposed surfaces of the locking bracket are wedged to a framing member of a building when the framing bracket is removably attached to the framing member and the framing bracket is in a locked position;

wherein the longitudinal axis is substantially skew with respect to a framing member axis;

wherein the support arm is perpendicular to the framing member axis when the framing bracket is in the locked position, the framing member axis extending through the framing member; and wherein the support arm is not perpendicular to the framing member axis when the framing bracket is in an unlocked position.

13. The framing bracket of claim 12, wherein the non-normal angle is an obtuse angle.

14. The framing bracket of claim 12, further comprising a plurality of anchor fasteners extending through the locking bracket and the anchoring bracket when the framing bracket is in the locked position to provide supplemental anchoring for the framing bracket.

15. The framing bracket of claim 12, wherein the locking bracket and the anchoring bracket are positioned on the frame such that a first plane extending through an open end and parallel to a closed surface of one either the locking or the anchoring bracket is normal to a second plane extending through an open end and parallel to a closed surface of the other bracket.

* * * * *